United States Patent [19]

Martin et al.

[11] Patent Number: 4,766,640

[45] Date of Patent: Aug. 30, 1988

[54] SELF-PROPELLED UPRIGHT VACUUM CLEANER HAVING A REMOTELY DISPOSED TRANSMISSION AND A POSITIVE LOCKING MECHANISM

[75] Inventors: Dean C. Martin, Golden Valley; Roderick E. Kleiss, Little Canada, both of Minn.; James A. Hardy, Boyle County, Ky.

[73] Assignee: Whirlpool Corporation, Benton Harbor, Mich.

[21] Appl. No.: 568

[22] Filed: Dec. 31, 1986

[51] Int. Cl.[4] ..... A47L 9/00

[52] U.S. Cl. ..... 15/340; 15/390; 180/19.3

[58] Field of Search ..... 15/340, 390; 180/19.3

[56] References Cited

U.S. PATENT DOCUMENTS

| | | | |
|---|---|---|---|
| 3,218,876 | 11/1965 | Berger | 15/340 X |
| 3,451,495 | 6/1969 | Bayless et al. | 15/340 X |
| 3,618,687 | 11/1971 | Ripple et al. | 15/340 X |
| 4,249,281 | 2/1981 | Meyer et al. | 15/340 |
| 4,615,071 | 10/1986 | Frohbieter | 15/340 |

*Primary Examiner*—Chris K. Moore

*Attorney, Agent, or Firm*—Mason, Kolehmainen, Rathburn & Wyss

[57] ABSTRACT

A self-propelled, upright suction or vacuum cleaner includes a base unit and a handle assembly pivotally extending therefrom that can be pivoted from an upright position to a comfortable operating position. The handle assembly includes a handle grip at one end and a drive system housing at its other end containing a drive system including a cleaner motor for propelling the cleaner. The drive system includes a transmission for transferring power from the cleaner motor to a pair of drive wheels fixedly secured to a drive axle. The transmission is remotely disposed from the drive axle and is connected thereto by a drive belt. The transmission includes an actuator that is controlled by a cable extending from the handle grip. As long as the handle grip maintains the actuator in a neutral position, the drive wheels are not rotated. If the handle grip is pushed or pulled by an operator, the actuator is pivoted by the cable and the transmission causes the drive wheels to propel the cleaner in a forward direction or a reverse direction, respectively. In order to ensure that the cleaner is not propelled by the drive wheels when the handle assembly is in its upright position, a positive acting locking mechanism that includes an actuator rod pivotably connected to the base unit causes a locking lever to be pivoted into engagement with the actuator to maintain the actuator in its neutral position.

12 Claims, 4 Drawing Sheets

SELF-PROPELLED UPRIGHT VACUUM CLEANER HAVING A REMOTELY DISPOSED TRANSMISSION AND A POSITIVE LOCKING MECHANISM

BACKGROUND OF THE INVENTION

A. Field of the Invention

The present invention relates to self-propelled suction or vacuum cleaners and, more particularly, to a new and improved self-propelled, upright vacuum cleaner having a drive system for propelling the cleaner in forward or reverse directions with a minimum amount of effort.

B. Description of the Prior Art

One type of vacuum cleaner is an upright vacuum cleaner, sometimes referred to as an upright suction cleaner. The upright suction or vacuum cleaner has a base unit which is designed to be moved along a floor covering, such as carpeting. The vacuum cleaner includes an operating motor which drives an impeller to provide suction to a nozzle in the base unit so that dust and other particulate matter from the floor covering can be deposited in a disposable dust bag. The cleaner additionally includes a rotating agitator brush which also makes contact with the floor covering to assist in the cleaning operation.

In those cleaners that do not have an internal drive system, the cleaner is moved along the floor by an operator pushing or pulling on a handle pivotally connected to the base unit. A considerable amount of force may be required to push or pull the vacuum cleaner over carpeting, particularly high pile or deep shag type carpets. In addition, vacuum cleaners can be relatively heavy due to the weight of their operating motors and other components. Therefore, many vacuum cleaners have been provided with an internal drive system to assist an operator in propelling the cleaner in forward and reverse directions along a floor covering.

These so called self-propelled suction or vacuum cleaners may include an internal drive system that selectively couples the output of the vacuum cleaner motor to a pair of drive wheels on the base unit. Examples of such self-propelled vacuum cleaners are disclosed in U.S. Pat. Nos. 4,249,281; 3,618,687 and 4,347,643. Typically, the internal drive system is placed in either a neutral or inoperative mode whenever the drive wheels are not to be driven or in an operative mode whenever the drive wheels are to propel the cleaner in a forward or reverse direction. The modes of the drive system are determined by the movement of a slidable handle grip on the distal end of the handle. For example, when an operator pushes on the handle grip, the cleaner is propelled in a forward direction by the drive wheels. If the operator pulls back on the handle grip, the drive wheels will be driven in the opposite or reverse direction. Alternatively, the handle grip can be positioned such that the drive system will be maintained in its neutral mode. The handle grip can be coupled to the drive system by a Bowden cable which extends from the handle grip along the handle to the drive system. One such type of vacuum cleaner having such a handle grip and cable arrangement is disclosed in U.S. patent application Ser. No. 663,737, filed on Oct. 22, 1984, now U.S. Pat. No. 4,624,027, issued Nov. 25, 1986, and assigned to the assignee of the present application.

In previously designed self-propelled upright vacuum cleaners, the drive systems including the cleaner motors are disposed in the base unit. The transmissions forming a part of the drive system normally are mounted integrally with or directly on the axle of the drive wheels being driven. However, there is often only a limited amount of space available to mount the drive system in the base unit. Moreover, it is desirable to ensure that the drive wheels are not driven when the handle is placed in its upright position so that the cleaner is not inadvertently propelled. In previously designed cleaners, this was accomplished by adjusting the neutral position of a clutch so that it was placed in its neutral position whenever the cleaner handle was in the upright position. However, it is desirable to provide a positive locking mechanism to force the clutch into a neutral position whenever the handle is placed in its upright position.

SUMMARY OF THE INVENTION

Accordingly, objects of the present invention are to provide a new and improved upright vacuum cleaner; to provide a new and improved vacuum cleaner having an internal drive system to assist in propelling the cleaner along a floor covering; to provide a new and improved self-propelled vacuum cleaner wherein the drive system is controlled by the movement of a Bowden cable attached to the handle grip of the vacuum cleaner; to provide a new and improved vacuum cleaner having a base unit and a pivotable handle assembly in which a drive system including a cleaner motor for propelling the cleaner is disposed; to provide a new and improved vacuum cleaner wherein a transmission is remotely disposed from the drive wheels; to provide a new and improved vacuum cleaner having an output shaft of a transmission unit displaced or offset from the drive axle of the drive wheels; to provide a new and improved vacuum cleaner having a positive locking mechanism to lock the drive system in neutral whenever the handle is in an upright position so that the drive wheels will not be driven whenever the handle is placed in that position; and to provide a new and improved vacuum cleaner in which a positive locking mechanism can be properly adjusted.

Briefly, the present invention constitutes a self-propelled, upright vacuum cleaner having a base unit which is propelled across a floor covering by a pair of drive wheels and a handle assembly pivotally mounted on the base unit. The handle assembly can be pivoted from an upright position to a comfortable operating position and includes a slidable handle grip at one end of a handle tube and a drive system housing at the other end of the handle tube adjacent the base unit. A drive system for the cleaner including a cleaner motor is contained in the drive system housing and will pivot with the handle tube. When the cleaner is turned on by a control switch on the handle tube adjacent the handle grip, the cleaner motor is energized and rotates an impeller disposed in an impeller housing located within the drive system housing. Suction is thereby produced in a nozzle extending from the front bottom portion of the base unit through the impeller housing to a conduit to which a dust collection bag is attached.

A drive sprocket on the output shaft of the cleaner motor is rotated whenever the cleaner motor is energized and drives a transmission belt which is disposed about the drive sprocket and a transmission input sprocket of a transmission unit. The transmission input sprocket is on an end of a shaft displaced or offset from, but parallel to the output shaft of the cleaner motor. If the cleaner is to be propelled in a forward direction, an operator of the cleaner need only to push on the handle grip. A control cable extending from the handle grip and through the handle tube causes a clutch actuator in the transmission to be pivoted such that a transmission output shaft and a transmission output sprocket thereon are rotated. A drive belt is disposed about the transmission output sprocket and a drive sprocket on a drive axle mounted on the drive system housing parallel to but offset from the transmission output shaft. The drive sprocket is rotated by the drive belt to rotate the drive axle and a pair of drive wheels affixed to the drive axle, thereby propelling the cleaner in a forward direction. If the operator pulls on the handle grip, the cleaner will be propelled in an opposite or reverse direction because the control cable causes the clutch actuator to be pivoted to another position to drive the transmission output sprocket and the drive sprocket in an opposite direction.

If the handle grip is placed in a neutral position, the control cable pivots the clutch actuator into a neutral position; and neither the transmission output sprocket nor the drive wheels are rotated. A positive locking mechanism for preventing the drive system from rotating the drive wheels when the vacuum cleaner is in an upright position includes a control rod attached to the base unit, an adjusting link mechanism and a formed locking lever. The locking lever pivots into engagement with the clutch actuator whenever the handle assembly is in its upright position. When the locking lever so engages the clutch actuator, the actuator is maintained in its neutral position so that the cleaner will not be inadvertently propelled along the floor covering.

BRIEF DESCRIPTION OF THE DRAWING

The above and other objects and advantages and novel features of the present invention will become apparent from the following detailed description of the preferred embodiment of the present invention illustrated in the accompanying drawing wherein.

DESCRIPTION OF THE PREFERRED EMBODIMENT

Figure 2:
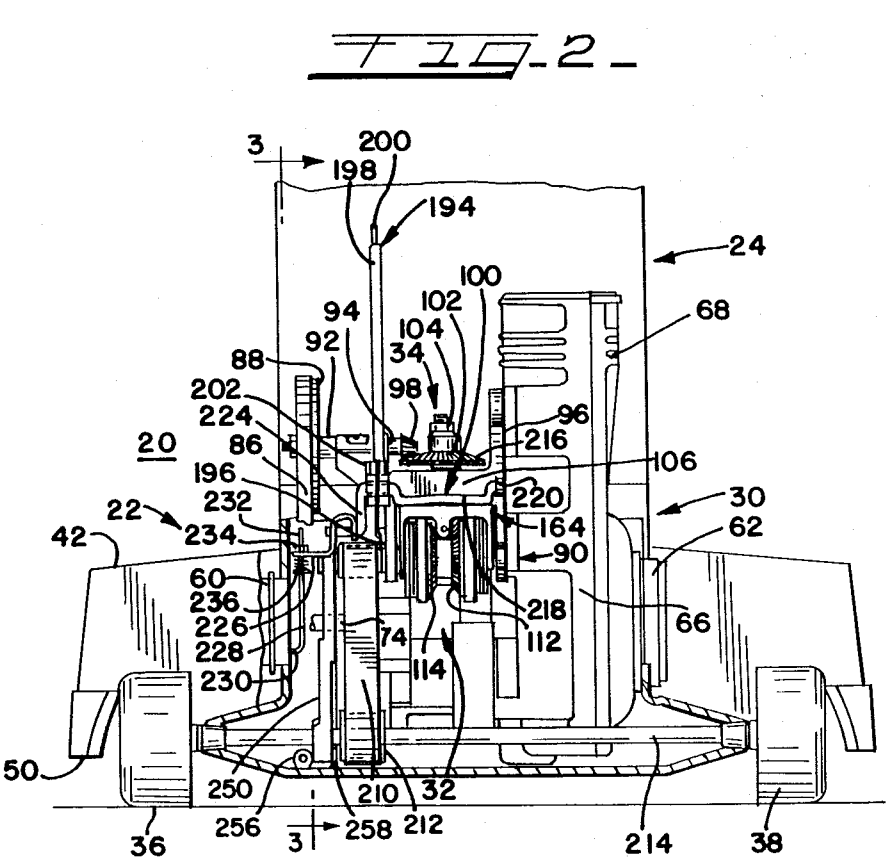
FIG. 2 is an enlarged, partially cut away, planar rear view of the vacuum cleaner depicted in FIG. 1.
Figure 1:
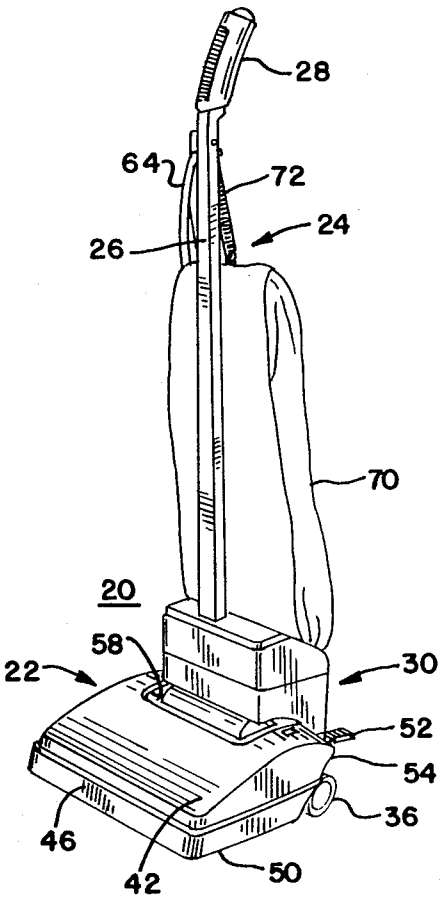
FIG. 1 is a perspective view of an upright vacuum cleaner constructed in accordance with the principles of the present invention.
Figure 3:
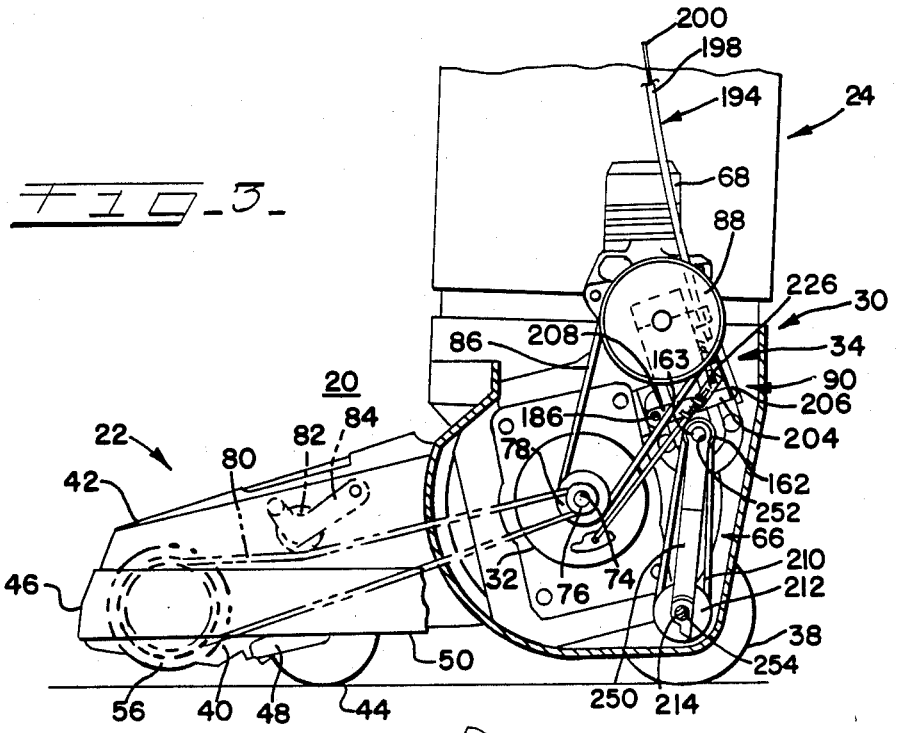
FIG. 3 is, a partially cut away, sectional view of the device of FIG. 1 taken along line 3—3 of FIG. 2 with the handle assembly in an upright position.
Figure 4:
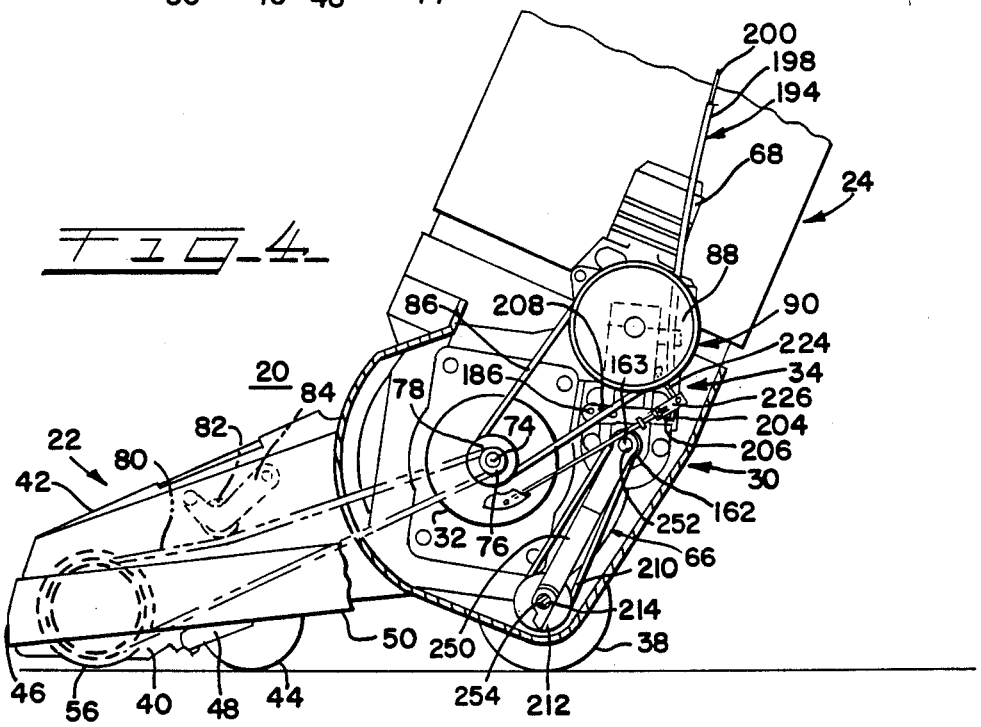
FIG. 4 is a view similar to FIG. 3, but depicting the handle assembly in a pivoted, operating position instead of an upright position.

Referring initially to FIGS. 1-4 of the drawing, there is illustrated a new and improved, self-propelled, upright suction or vacuum cleaner 20 constructed in accordance with the principles of the present invention. The cleaner 20 includes a base unit 22 and a handle assembly 24 pivotally mounted to the base unit 22. The handle assembly 24 has an elongated hollow tube 26 extending between an axially movable handle grip 28 at a distal end of the tube 26 and a drive system housing 30 that houses a drive system 34 including a cleaner motor 32 and a pair of drive wheels 36 and 38 driven by the motor 32. As long as the handle assembly 24 is in its upright position (FIGS. 1–3), the drive system 34 is maintained or locked in a neutral or inoperative condition such that the drive wheels 36 and 38 are not driven by the motor 32. In order for the cleaner 20 to be propelled forward across a floor covering after the cleaner 20 is turned on by an operator, the handle assembly 24 first must be pivoted away from its upright position so as to be in an operative position (FIG. 4). When the handle grip 28 is pushed forward or downwardly along the longitudinal axis of the tube 26 by the operator, the drive system 34 drives the drive wheels 36 and 38 in such a manner that the cleaner 20 is propelled forwardly across a floor covering. If it is desired to reverse the direction of travel of the cleaner 20, the operator need only to pull on the handle grip 28 and thereby move the handle grip 28 rearwardly or upwardly along the longitudinal axis of the tube 26. The drive wheels 36 and 38 are then driven by the drive system 34 in a reverse direction causing the cleaner 20 to move in reverse.

The base unit 22 has a base frame member 40 (FIG. 3) covered by a cover or hood 42. A pair of freely rotatable front wheels 44 are mounted on the frame member 40 near a front end 46 of the base unit 22 by an adjustable support 48. Since the wheels 44 are mounted by the support 48, the wheels 44 can be positioned relative to a bottom edge 50 of the base unit 22 by a height adjustment lever 52 (FIG. 1) projecting from a rear end 54 of the base unit 22. Consequently, the adjustment of the front wheels 44 relative to the base frame 40 allows the amount of clearance between the floor and the bottom edge 50 of the base unit 22 to be controlled. For example, the base unit 22 may be raised to a higher level when the cleaner 30 is used on deep or shag carpeting. A rotating brush or agitator 56 also is mounted in the base unit 22 near the front end 46 to assist in cleaning operations.

A central recess 58 (FIG. 1) is formed in the frame 40 and in the hood 42 near the rear end 54 of the base unit 22 so that the housing 30 on the handle assembly 24 may be pivotally mounted to the frame member 40 of the base unit 22. As best seen in FIG. 2, the housing 30 containing the drive system 34 including the motor 32 is pivotally connected to the frame member 40 of the base unit 22 by supports 60 and 62 extending from the base unit 22. As a result, the handle assembly 24 including the tube 26 and the housing 30 may be placed in a number of positions relative to the base unit 22, including an upright position (FIGS. 1–3) when the cleaner 20 is not being used. A conventional latch (not shown) may be provided to maintain the handle assembly 24 in an upright position. When the cleaner 20 is to be used for cleaning, the handle assembly 24 may be pivoted to a comfortable operating position (FIG. 4).

When the cleaner 20 is energized, power is supplied to the motor 32 through a power supply cord 64 that can be stored on the tube portion 26 of the handle assembly 24 and that extends inside the tube 26 to the motor 32. The energization of the motor 32 is controlled by a conventional switch (not illustrated) positioned near the handle grip 28 on the handle assembly 24. Whenever the motor 32 is energized, a conventional impeller or suction fan (not illustrated) located adjacent the motor 32 in an impeller housing 66 is rapidly rotated to provide suction at a nozzle adjacent the front end 46 of the base unit 22 through the impeller housing 66 and to a conduit 68 projecting from the impeller housing 66. A dust collection bag is disposed about the conduit 68 and is positioned either in a vacuum bag 70 that is mounted by a spring retainer 72 on the hollow tube 26 of the handle assembly 24 or, alternatively, in a conventional rigid plastic housing (not illustrated).

The motor 32 has an output shaft 74 to which is affixed a brush drive sprocket 76 and a transmission drive sprocket 78. When the motor 32 is energized, the shaft 74 and the sprockets 76 and 78 are rotated in a counterclockwise direction (FIGS. 3 and 4). A synchronous brush belt 80 is disposed about the sprocket 76 and the brush 56 and is driven by the sprocket 76 to rotate the brush 56 in a counterclockwise direction (FIGS. 3 and 4). In order to ensure that the brush belt 80 is maintained in proper tension, a conventional idler roller 82 on an idler arm 84, positioned in the base unit 22, engages the brush belt 80.

Figure 5:
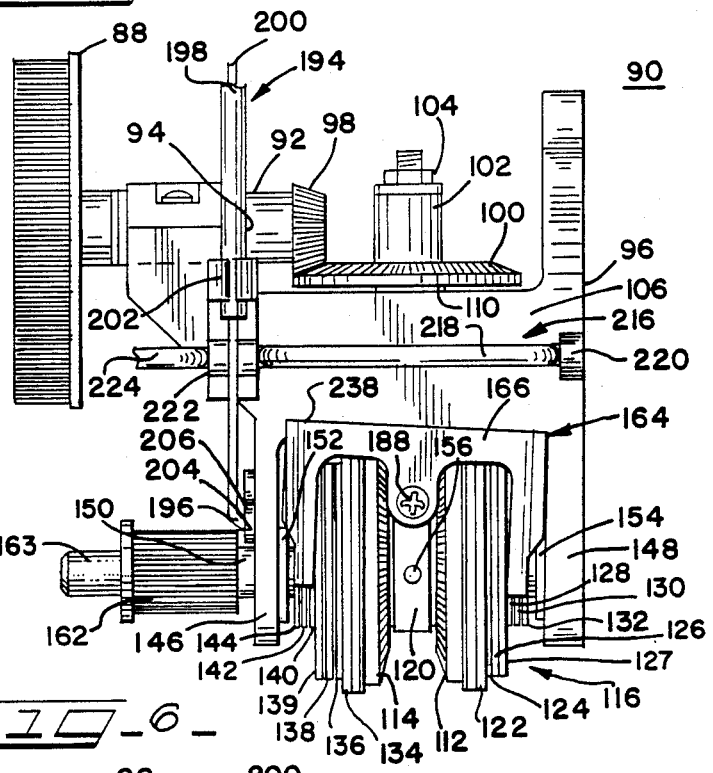
FIG. 5 is an enlarged, elevational view of the transmission unit used in the vacuum cleaner of FIG. 1 depicted such that the vacuum cleaner will be propelled in a forward direction.

A transmission belt 86 is disposed about the sprocket 78 and a transmission input sprocket 88 of a transmission 90 which forms a part of the drive system 34 and which is securely mounted on the impeller housing 66. The transmission belt 86 is driven whenever the motor 32 is running. Consequently, the input sprocket 88 is also rotated in a counterclockwise direction (FIGS. 3 and 4). The transmission input sprocket 88 is affixed to a shaft 92 (FIGS. 2 and 5). The shaft 92 is mounted in a sleeve bearing 94; and the bearing 94 is press fitted into a transmission chassis 96. As is evident from FIGS. 2–4, the shaft 92 is offset or displaced from, but is generally parallel to the output shaft 74 of the motor 32. A bevel pinion gear 98 is disposed at the other end of the shaft 92 such that the gear 98 is rotated whenever the sprocket 88 is rotated by the transmission belt 86. Another bevel gear 100 drivingly engaged with the gear 98 has a shaft 102 extending from it and is positioned on the transmission chassis 96 at a right angle to the pinion gear 98 by a fastener 104. Accordingly, whenever the bevel gear 98 is rotated, the gear 100 will be rotated.

The shaft 102 of the gear 100 extends through a central portion 106 of the transmission chassis 96 and is connected to another bevel pinion gear 108 (FIG. 6) at a lower portion of the transmission chassis 96. The placement of the bevel gears 100 and 108 relative to the central portion 106 of the transmission chassis 96 can be adjusted by means of a shim 110 located between the transmission chassis 96 and the gear 100. The bevel gear 108 is disposed such that it meshes with a pair of bevel gear and clutch pad assemblies 112 and 114 that form a part of a clutch mechanism 116 for the transmission 90. Each of the assemblies 112 and 114 includes a bevel gear mechanically locked and adhesively bonded to a clutch pad.

The assemblies 112 and 114 of the clutch mechanism 116 (FIG. 8) are mounted on a bearing 118 having a collar 120 such that the assemblies 112 and 114 can rotate independently of the bearing 118. A force plate 122, a thrust washer 124, a thrust bearing 126, a thrust washer 127, a thrust washer 128, a thrust bearing 130 and a thrust washer 132 are provided adjacent the assembly 112 about one end of the bearing 118. Similarly, a force plate 134, a thrust washer 136, a thrust bearing 138, a thrust washer 139, a thrust washer 140, a thrust bearing 142 and a thrust washer 144 are disposed adjacent the assembly 114 about another end of the bearing 118. The force plates 122 and 134 have internally extending projections that extend into grooves along the outer periphery of the bearing 118 such that bearing 118 is constrained to rotate with the force plates 122 and 134. The clutch mechanism 116, including specifically the bearing 118, is positioned between lower extending legs 146 and 148 of the transmission chassis 96 by a transmission output shaft 150 which is inserted in bearings 152 and 154 in the legs 146 and 148, respectively. A pin 156 (FIG. 5) projects through an opening 158 (FIG. 8) in the collar 120 and the bearing 118 and into an opening 160 in the output shaft 150 such that the output shaft 150 is constrained to rotate with the bearing 118. A transmission output sprocket 162 is affixed to the output shaft 150; and a shaft extension 163 extends axially outwardly from the output sprocket 162.

Figures 7, 8, 9:
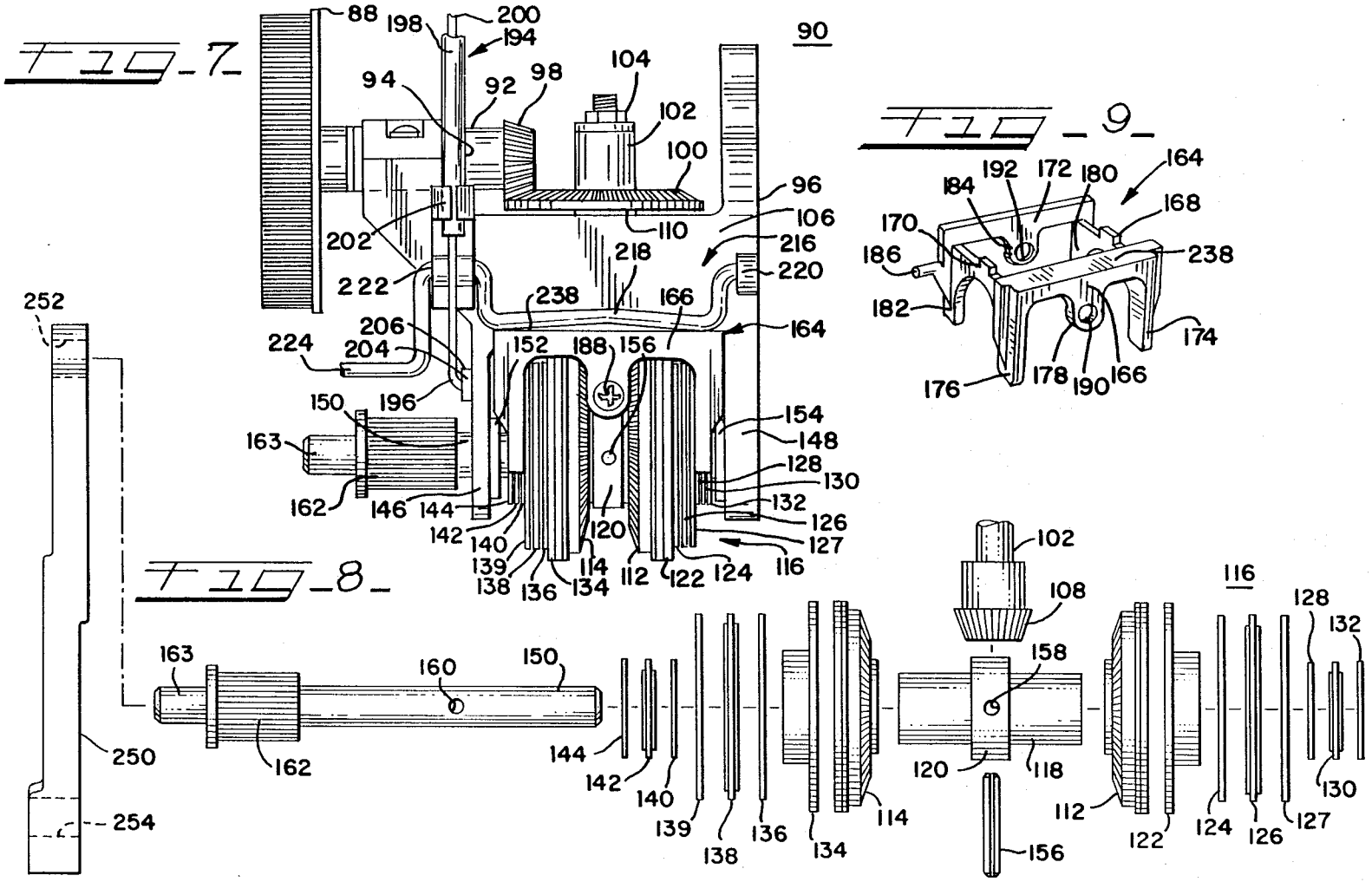
FIG. 7 is a view similar to FIG. 5 with the transmission unit locked in a neutral position so that the drive wheels of the vacuum cleaner will not be driven.
FIG. 8 is an exploded, elevational view of a portion of the transmission unit shown in FIGS. 5–7.
FIG. 9 is a perspective view of the actuator portion of the transmission unit depicted in FIGS. 5–7.

The bevel gear and clutch pad assemblies 112 and 114 are configured such that they are rotated on the bearing 118 by the gear 108 in opposite directions. Since the assemblies 112 and 114 can rotate freely with respect to the bearing 118, the output shaft 150 and the output sprocket 162 are not rotated unless the clutch mechanism 116 forces either the force plate 122 toward the assembly 112 or the force plate 134 toward the assembly 114. An actuator 164 is shown in FIG. 9 of the drawing and is used to force one or the other of the force plates 122 and 134 toward the corresponding assemblies 112 and 114.

More specifically, the actuator 164 (FIG. 9) is of a double E-shaped configuration having an E-shaped end 166 connected by arched walls 168 and 170 to an E-shaped end 172. The end wall 166 has outer leg portions 174 and 176 and a central leg portion 178. The end wall 172 has leg portions 180 and 182 with a central leg portion 184. A rod 186 projects from the side of the leg 182. The rod 186 responds to the movement of the handle grip 28 to properly position the actuator 164 with respect to the thrust washers 127 and 139.

The actuator 164 is mounted below the central portion 106 of the transmission chassis 96 by screws 188 projecting through a hole 190 in the leg 178 and a hole 192 in the leg 184. The screws 188 have collars disposed in the holes 190 and 192 such that the actuator 164 can pivot about the screws 188 within the opening between the legs 146 and 148 extending downwardly from the transmission chassis 96. As previously indicated, the pivoting of the actuator 164 is controlled by the movement of the handle grip 28. In this connection, a Bowden cable 194 (FIGS. 2–5) extends from an actuator lever 196 (FIG. 5) attached to the leg 146 of the transmission chassis 96. The Bowden cable 194 is conventional, per se, and has an outer sheath 198 and an inner push-pull cable 200 which can move within the outer sheath 198. The sheath 198 is held in a fixed position on the transmission chassis 96 by a spring clamp 202. The Bowden cable 194 extends from the transmission chassis 96 through the hollow tube 26; and one end of the push-pull cable 200 is affixed to the handle grip 28. When an operator desires to have the cleaner 20 move in a forward direction, the handle grip 28 is pushed toward the base unit 22 and the cable 200 is pushed forward or downwardly (FIG. 5). This downward movement of the cable 200 forces an end 204 of the actuator lever 196 downwardly because an end portion 206 of the cable 200 is connected to the end 204 of the lever 196.

The lever 196 is pivotally mounted on the leg 146 of the transmission chassis 96 such that when the end 204 is forced downwardly (FIG. 5), an end 208 (FIG. 4) of the lever 196 is forced upwardly. Since the actuator rod 186 projecting from the leg 182 of the actuator 164 is constrained to move with the end 208 of the lever 196, the upward movement of the end 208 of the lever 196 forces the rod 186 upwardly so that the actuator 164 pivots about the holes 190 and 192 in the legs 178 and 184 (FIG. 9), respectively, placing the actuator 164 in a forward propelling position (FIG. 5). When the actuator 164 is so pivoted, the legs 174 and 180 contact the thrust washer 127 and force the thrust washer 127, the thrust bearing 126, the thrust washer 124 and the force plate 122 to drivingly engage the assembly 112 such that the force plate 122 rotates with the assembly 112. As the plate 122 rotates, the bearing 118, the shaft 150 and the sprocket 162 are also rotated in a counterclockwise direction (FIG. 4). The drive system 34 also includes a drive belt 210 that is disposed about the sprocket 162 and a drive sprocket 212, resulting in the rotation of the sprocket 212 in a counterclockwise direction (FIG. 4).

The sprocket 212 is affixed to a drive axle 214 to which are affixed the drive wheels 36 and 38. The sprocket 212, the axle 214 and the drive wheels 36 and 38 form portions of the drive system 34. As is seen in FIG. 2 of the drawing, the drive axle 214 is mounted on the housing 30. Consequently, the rotation of the sprocket 212 will cause the drive wheels 36 and 38 to rotate in a counterclockwise direction (FIG. 4); and the cleaner 20 will be propelled in a forward direction. As can be seen in FIGS. 2–4, the transmission 90 does not directly engage the drive axle 214 but is remotely disposed from the drive axle 214 and drivingly interconnected therewith through the drive belt 210. The remote disposition of the transmission 90 from the drive axle 214 is most advantageous where space for the components of the drive system 34 is limited.

Figure 6:
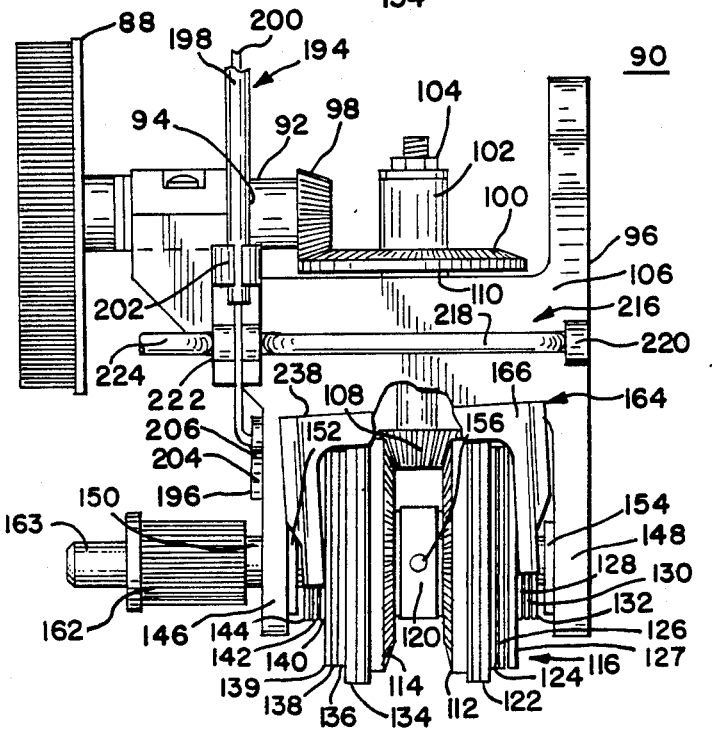
FIG. 6 is a view similar to FIG. 5 with the transmission unit depicted such that the vacuum cleaner will be propelled in a reverse direction.

If an operator of the cleaner 20 desires to have the cleaner 20 propelled in a reverse direction, the handle grip 28 is moved rearwardly or upwardly on the tube 26, causing the cable 200 to be moved upwardly (FIG. 6). When the cable 200 is so moved, the end 204 of the lever 196 is also pulled upwardly resulting in the downward movement of the end 208 of the lever 196 and the pivoting of the actuator 164 to the position shown in FIG. 6. The legs 176 and 182 of the actuator 164 then force the thrust washer 139, the thrust bearing 138, the thrust washer 136 and the force plate 134 against the rotating assembly 114, resulting in the corresponding rotation of the force plate 134. The rotation of the force plate 134 causes the bearing 118 and the shaft 150 and the sprocket 162 to rotate in a clockwise direction (FIG. 4). The drive belt 210 therefore rotates the drive sprocket 212 and the wheels 36 and 38 in a clockwise direction (FIG. 4). Accordingly, the cleaner 20 is propelled rearwardly.

When the actuator 164 is placed by the cable 200 in a neutral position (FIG. 7), neither the force plate 122 nor the force plate 134 rotates with either of the assemblies 112 and 114; and, therefore, the bearing 118 does not rotate. As a result, the wheels 36 and 38 are not driven by the belt 210 because the belt 210 is not being driven by the output sprocket 162.

In order to ensure that the actuator 164 is maintained in its neutral position (FIG. 7) so that the cleaner 20 will not be inadvertently propelled along the floor when the handle assembly 24 is in its upright position (FIGS. 1–3), a positive acting neutral locking mechanism 216 (FIGS. 2–7) is provided. The locking mechanism 216 includes a generally U-shaped formed lever 218 pivotally held on the transmission chassis 96 by a projecting nib 220 and by a clamp 222. A lock control portion 224 extends from the lever 218 and is pivotally connected to an angularly shaped link 226. The link 226 is connected to a rod 228, one end 230 of which is rotatably connected to the base unit 22 (FIG. 2) and another end 232 of which extends through the link 226. A nut 234 is screwed on the end 232 so as to secure the rod 228 to the link 226. A spring 236 is positioned on the other side of the link 226 from the nut 234 for enabling the locking lever 218 to be properly positioned relative to the actuator 164 during the final assembly of the cleaner 20.

When the handle assembly 24 is placed in its upright position, the rod 228 pivots the link 226 and the control portion 224 such that the formed lever 218 is pivoted to its locking position (FIGS. 2, 3 and 7) wherein the lever 218 engages a top bevelled edge 238 of the actuator 164. In this position, the lever 218 forces the actuator 164 (and the lever 196) into a neutral position (FIG. 7) so that the transmission 90 cannot transfer power from the motor 32 to the wheels 36 and 38 and so that the cleaner 20 cannot be inadvertently propelled along the floor.

When the handle assembly 24 is moved into an operating position (FIG. 4), the rod 228 pivots the link 226 to move the locking lever 218 (FIGS. 5 and 6) out of its locking position. When the locking lever 218 is moved out of its locking position, the actuator 164 is allowed to pivot under the influence of the cable 200 to enable the transmission 90 to transfer power from the motor 32 to the drive wheels 36 and 38; and the cleaner 20 can be propelled across a floor covering. In order to maintain a constant spacing between the shaft 150 and the drive axle 214, a rigid, metallic brace 250 is disposed therebetween. The brace 250 includes an upper aperture 252 for receiving the shaft extension 163 of the transmission output shaft 150 and also includes a lower aperture 254 through which the drive axle 214 extends. The apertures 252 and 254 are dimensioned to permit the free rotation therein of the shaft extension 163 and of the drive axle 214. The brace 250 is retained in its position (FIG. 2) by any suitable means, for example, by being physically disposed or captured between an upstanding boss 256 and an elongated rib 258.

Obviously, many modifications and variations of the present invention are possible in light of the above teachings. Thus, it is to be understood that, within the scope of the appended claims, the invention may be practiced otherwise than as specifically described hereinabove.

What is claimed and desired to be secured by Letters Patent is:

1. A self-propelled, upright vacuum cleaner comprising a base unit, a handle assembly pivotally mounted on said base unit for movement between an upright position and an operating position, a cleaner motor having a motor output shaft, at least one drive wheel for propelling said vacuum cleaner, a drive shaft to which said drive wheel is attached for rotating said drive wheel, a transmission for transferring the power from said motor to said drive wheel, said transmission having a transmission input shaft coupled to said motor output shaft and a transmission output shaft coupled to said drive shaft, said transmission being disposed in said cleaner remote from said drive shaft, elongated drive belt means for coupling said transmission output shaft to said drive shaft, manually engageable means mounted on said handle assembly for controlling said transmission, an actuator for controlling the movement of said transmission output shaft, said actuator including opposed E-shaped end walls connected by spaced-apart side walls and being mounted in said transmission for pivotal movement, clutch means included in said transmission and responsive to said actuator for controlling the movement of said transmission output shaft, an elongated cable connected between said control means and said actuator for moving said actuator in response to the movement of said control means, said actuator being movable by said cable to a first position such that said transmission output shaft is rotated in a first direction, to a second position such that said transmission output shaft is rotated in a second, opposite direction and to a third position such that said transmission output shaft is not rotated and locking means for engaging and maintaining said actuator in said third position when said handle assembly is in said upright position.

2. A vacuum cleaner comprising a base unit having a rotatable brush for cleaning operations, a handle assembly projecting from and pivotally mounted on said base unit, a motor and a transmission for said motor both mounted on said handle assembly and pivotally movable with respect to said base unit, a pair of drive wheels mounted on said handle assembly for propelling said vacuum cleaner, a first belt means for coupling said motor to said transmission, a second belt means for coupling said transmission to said drive wheels, control means coupled to said transmission to control the rotation and the direction of rotation of said drive wheels, an actuator included in said transmission and coupled to and controllably positioned by said control means, said actuator having a first position in which said transmission causes said drive wheels to be rotated in a first direction, a second position in which said transmission causes said drive wheels to be rotated in a second, opposite direction and a third position in which said transmission does not effect the rotation of said drive wheels, and locking means connected between said base unit and said handle assembly for maintaining said actuator in said third position when said handle assembly is in a predetermined position.

3. A vacuum cleaner as recited in claim 2 wherein said locking means enables said actuator to be positioned in said first position or said second position when said handle assembly is not in said predetermined position.

4. A vacuum cleaner as recited in claim 2 wherein said locking means includes a control rod connected to said base unit and a formed member mechanically interconnected with and controllably movable by said control rod, said control rod moving said formed member into locking engagement with said actuator when said handle assembly is in said predetermined position.

5. A vacuum cleaner as recited in claim 4 wherein said locking means further includes spring means for adjustably interconnecting said control rod to said formed member.

6. A vacuum cleaner comprising a floor engaging unit, a handle assembly pivotally mounted on said floor engaging unit, a pair of drive wheels for propelling said vacuum cleaner, a cleaner motor for providing power to said drive wheels, a transmission driven by said cleaner motor for driving said drive wheels, said transmission including clutch means for selectively enabling said transmission to drive said drive wheels and an actuator for controlling said clutch means and locking means connected to both said floor engaging unit and said handle assembly for maintaining said actuator in a position such that said transmission does not drive said drive wheels.

7. A vacuum cleaner as recited in claim 6 wherein said actuator includes at least a pair of spaced apart legs for alternately contacting said clutch means to drive said drive wheels in a selected one of two opposite directions and wherein said locking means includes a formed member for engaging said actuator to maintain said legs out of contact with said clutch means.

8. A vacuum cleaner as recited in claim 7 wherein said formed member engages said actuator along a bevelled edge of said actuator.

9. A vacuum cleaner as recited in claim 7 wherein said handle assembly includes a handle control mounted at an end of said handle assembly remote from said floor engaging unit and an elongated cable extending from said handle control to said actuator for controlling the movement of said actuator.

10. A vacuum cleaner as recited in claim 9 wherein said actuator is connected to a movable control lever, said control lever being connected to and movable by said cable alternately to place said legs into contact with said clutch means to drive said drive wheels in one of said two opposite directions.

11. A vacuum cleaner as recited in claim 6 wherein said locking means includes an elongated control rod pivotally connected to said floor engaging unit and a formed member for engaging said actuator connected to both said control rod and said handle assembly, said control rod moving said formed member into engagement with said actuator to maintain said actuator in said position when said handle assembly is placed in a predetermined position.

12. A vacuum cleaner as set forth in claim 11 wherein said locking means further includes spring means for adjustably connecting said control rod to said formed member.

* * * * *